US012158043B1

(12) United States Patent
Strohla

(10) Patent No.: US 12,158,043 B1
(45) Date of Patent: Dec. 3, 2024

(54) BI-DIRECTIONAL SWIVEL SUB WITH LUGS

(71) Applicant: Halliburton Energy Services, Inc., Houston, TX (US)

(72) Inventor: Nick Strohla, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 7 days.

(21) Appl. No.: 18/204,299

(22) Filed: May 31, 2023

(51) Int. Cl.
*E21B 17/05* (2006.01)
*E21B 17/06* (2006.01)

(52) U.S. Cl.
CPC ..... *E21B 17/06* (2013.01); *E21B 17/05* (2013.01)

(58) Field of Classification Search
CPC ..... E21B 23/004; E21B 23/006; E21B 17/05; E21B 17/06
See application file for complete search history.

(56) References Cited

U.S. PATENT DOCUMENTS 4,303,135 A 12/1981 Benoit
5,782,304 A * 7/1998 Garcia-Soule ..... E21B 23/006 166/356
6,655,464 B2 * 12/2003 Chau ..... H01R 13/533 175/320
8,511,392 B2 8/2013 Howlett et al.
9,683,412 B2 6/2017 Richards
9,784,073 B2 10/2017 Bailey et al.
10,294,730 B2 * 5/2019 Heide ..... E21B 17/046
2005/0045339 A1 3/2005 Hall et al.
2010/0288505 A1 11/2010 Brown
2016/0168923 A1 6/2016 Richards
2018/0187502 A1 * 7/2018 Cridland ..... E21B 23/0411
2021/0254432 A1 8/2021 Honeker et al.

OTHER PUBLICATIONS

International Search Report and Written Opinion for International Patent Application No. PCT/US2023/027237 dated Feb. 22, 2024. PDF file. 9 pages.

* cited by examiner

*Primary Examiner* — Robert E Fuller
(74) *Attorney, Agent, or Firm* — Scott Richardson; C. Tumey Law Group PLLC

(57) ABSTRACT

An apparatus may include a connector sub rigidly securable to a conveyance for running the connector sub along a wellbore. The connector sub has a connector lug. Further, the apparatus may include a spool mandrel coupled to the connector sub and having a mandrel lug. The spool mandrel is rotatable with respect to the connector sub, and contact between the connector lug and the mandrel lug bounds rotation of the spool mandrel with respect to the connector sub between a first angular position and a second angular position. Additionally, the apparatus includes a control line extending between the connector sub and the spool mandrel. The control line is displaceable to permit rotation of the spool mandrel with respect to the connector sub.

20 Claims, 8 Drawing Sheets

BI-DIRECTIONAL SWIVEL SUB WITH LUGS

BACKGROUND

In the process of completing an oil or gas well, a casing string is run downhole into a wellbore to protect the wellbore from failure (e.g., collapse, erosion) and provide a fluid path for hydrocarbons during production. To access the hydrocarbons for production, a perforating gun system may be deployed into the casing string to form perforations through the casing and wellbore wall such that hydrocarbons may flow into the casing string via the perforation. Downhole completion tools may be run-in-hole once the perforations are formed. For example, a flow regulating system may be disposed proximate the perforations. The flow regulating system may have a screen assembly that controls and limits debris, such as gravel, sand, and other particulate matter, from entering the tubular as the fluid passes through the screen assembly from the perforations. The flow regulating system or other completion tools/assemblies may include completion devices (e.g., inflow control devices, valves, sensors, etc.) that require electricity and/or control signals (e.g., electrical, light, or hydraulic) from the surface to operate.

However, the flow regulating system, or other downhole tools, may not extend to the surface as they may be disposed deep in the wellbore proximate the perforations. As such, running a control line from the surface to the downhole tools may be required to operate these downhole tools. Unfortunately, it may be difficult to run the control line to the downhole tool in the correct angular orientation for coupling as the tubular running the control line and/or the downhole tool may rotate or twist from their respective surface orientations while being run-in-hole. Failing to achieve the correct angular orientation between the control line and the downhole tool may require adjustments to the tubular running the control line, which may be time consuming and costly. Further, over rotation of the tubular may strain and damage the control line, which may interrupt production operations. As such, a system is needed that may run the control line in hole to a correct angular orientation with respect to the downhole tool without straining or damaging the control line, which may improve overall production efficiency.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for connecting a downhole tool with the surface via a control line and, more particularly, example embodiments may include an apparatus (e.g., a swivel sub) for running the control line to the downhole tool. The apparatus includes a connector sub secured to a conveyance (e.g., tubular), as well as a spool mandrel that is rotatably coupled to the connector sub. The control line extends from the surface along the conveyance and across the swivel sub. The control line is displaceable to permit at least some rotation of the spool mandrel with respect to the connector sub without straining and damaging the control line. However, rotation of the spool mandrel with respect to the connector sub is limited between a first angular position and a second angular position by contact between a connector lug of the connector sub and a mandrel lug of the spool mandrel to prevent over rotation of the spool mandrel, which may strain and damage the control line. However, rotation of the swivel sub between the first angular position and the second angular position may be sufficient rotation to allow the control line to be moved into the correct angular orientation to couple with the downhole tool such that electricity and/or control signals (e.g., electrical, light, and/or hydraulic) may be transmitted between the surface to the downhole tool.

Figure 1:
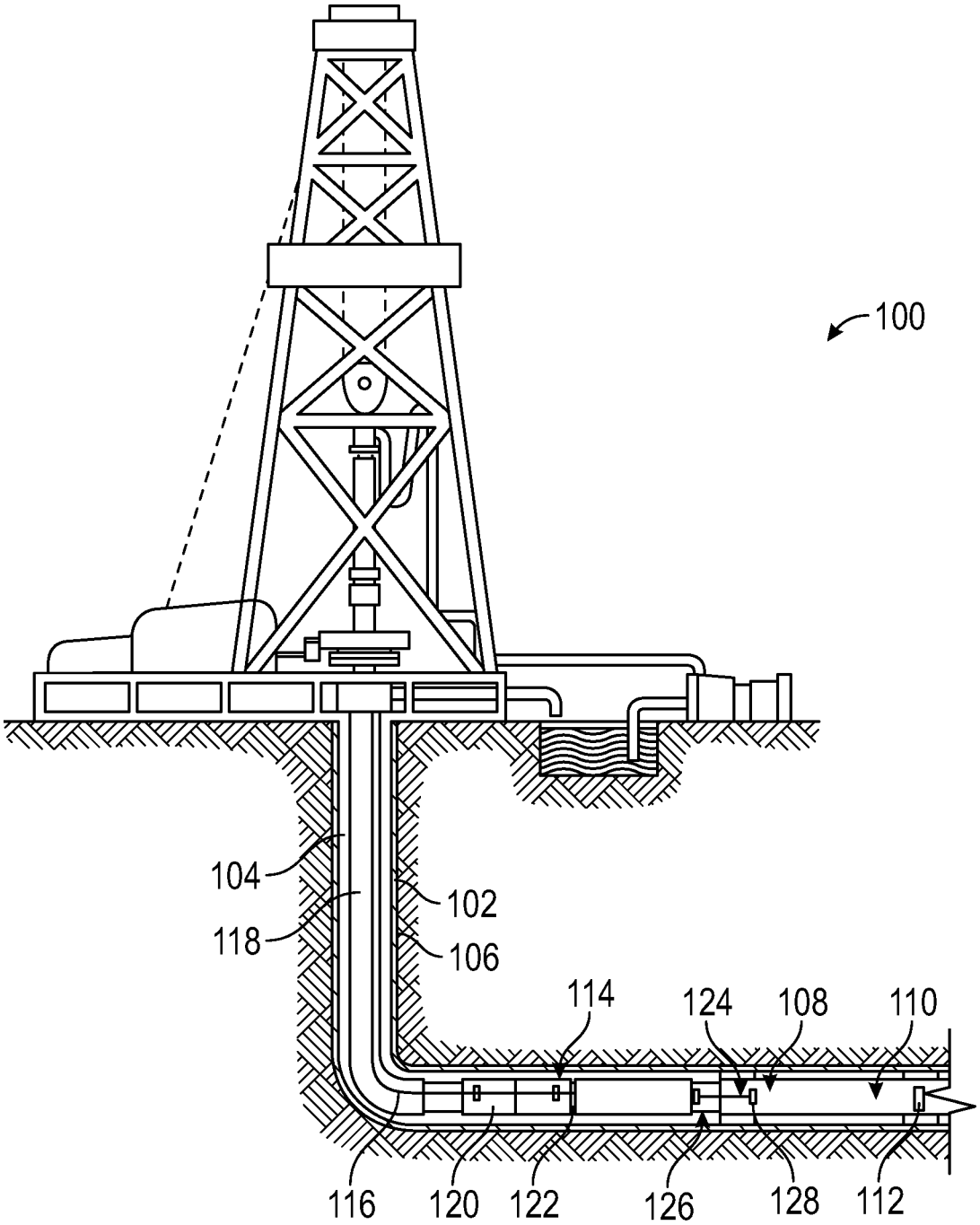
FIG. 1 illustrates an elevation view of a well system, in accordance with some embodiments of the present disclosure.

FIG. 1 illustrates an elevation view of a well system 100, in accordance with some embodiments of the present disclosure. As illustrated, casing 102 may be run downhole into a wellbore 104 to protect the wellbore 104 from failure (e.g., collapse, erosion) and provide a fluid path for hydrocarbons during production. To access the hydrocarbons for production, a perforating gun system may be deployed into the casing 102 to form perforations in the casing 102 and wellbore wall 106 such that hydrocarbons may flow into the casing 102 via the perforation. Downhole completion tools 108 may be run-in-hole once the perforations are formed. For example, a flow regulating system 110 may be disposed proximate the perforations. The flow regulating system 110 may control and limits debris, such as gravel, sand, and other particulate matter, from entering the casing 102 as the fluid passes through the flow regulating system 110 from the perforations. Further, the flow regulating system 110 or other completion tools/assemblies may include completion devices 112 (e.g., inflow control devices, valves, sensors, etc.) that require electricity and/or control signals (e.g., electrical, light, and/or hydraulic) from the surface to operate. Accordingly, as set forth above, a swivel sub apparatus 114 may be run-in-hole with a control line to couple a control line 116 to the respective downhole tool 108 such that electricity and/or control signals may be transmitted between the surface to the downhole tool 108.

In particular, the swivel sub 114 may be run-in-hole, via a conveyance 118 (e.g., a tubular). The swivel sub 114 includes a connector sub 120 secured to the conveyance 118, as well as a spool mandrel 122 that is rotatably coupled to the connector sub 120. Moreover, the control line 116 extends from the surface along the conveyance 118 and across the swivel sub 114 such that a mating end 124 of the control line 116 is disposed at a downhole end 126 of the swivel sub 114. The control line 116 may be displaceable to prevent strain on the control line 116 from rotation or twisting of the conveyance 118 as the swivel sub 114 is run-in-hole. Further, as set forth above, the control line 116 is also displaceable to permit rotation of the spool mandrel 122 with respect to the connector sub 120 between a first angular position and a second angular position (shown in FIGS. 5A-C). Indeed, the swivel sub 114 may only be configured to couple to the downhole tool 108 in a particular angular orientation.

The spool mandrel 122 may rotate between the first angular position and the second angular position to align the mating end 124 of the control line 116 with a corresponding connector 128 of the downhole tool 108 as the conveyance 118 drives the swivel sub 114 toward and/or into the downhole tool 108. Contact between the swivel sub 114 and the downhole tool 108 may drive rotation of the swivel sub 114 to the particular angular orientation with respect to the downhole tool 108. The swivel sub 114 and/or the downhole tool 108 may comprise at least one guide feature configured to drive rotation of the spool mandrel 122 of the swivel sub 114 in response to contact between the swivel sub 114 and the downhole tool 108. Alternatively, the swivel sub 114 may be configured to self-rotate to the particular angular orientation via any suitable mechanical, electrical, hydraulic, pneumatic, and/or magnetic driving mechanism. Driving the swivel sub 114 into the downhole tool 108 in the particular angular orientation (e.g., with the mating end 124 of the control line 116 aligned with the corresponding connector 128) may couple the control line 116 with the downhole tool 108 to put the downhole tool 108 in electrical communication with the surface such that electricity and/or control signals may be transmitted between the surface to the downhole tool 108.

Moreover, the conveyance 118 may pull the swivel sub 114 in the uphole direction to disengage the control line 116 and/or the swivel sub 114 from the downhole tool 108 in response to an unsuccessful coupling with the downhole tool 108. As set forth in greater detail below, the swivel sub 114 may include a return spring (shown in FIG. 3) to drive the spool mandrel 122 to rotate toward a neutral angular position of the spool mandrel 122 with respect to the connector sub 120 in response to disengaging the swivel sub 114 from the downhole tool 108. Having the swivel sub 114 in the neutral position may be ideal for coupling with the downhole tool 108 as the spool mandrel 122 may be configured to rotate freely from the neutral position to align the control line 116 with the corresponding connector 128 of the downhole tool 108. Accordingly, with the swivel sub 114 in the neutral position, the conveyance 118 may drive the swivel sub 114 into the downhole tool 108 to re-attempt to couple the control line 116 with the downhole tool 108. Having the return spring bias the swivel sub 114 to the neutral position, in response to disengaging the swivel sub 114 from the downhole tool 108, may permit the swivel sub 114 to re-attempt to couple with the downhole tool 108 from an ideal angular position after each disengagement from the downhole tool 108.

Figure 2A:
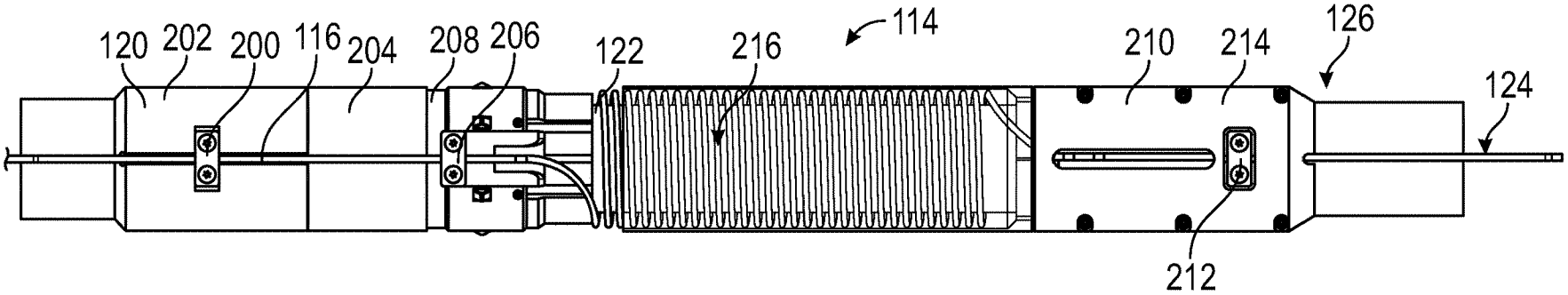
FIGS. 2A-B illustrate respective side views of a swivel sub apparatus, in accordance with some embodiments of the present disclosure.
Figure 2B:
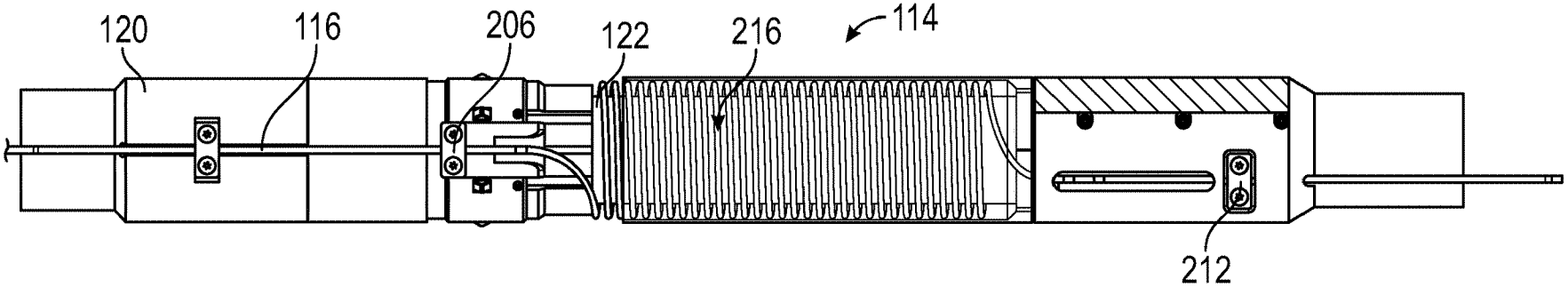

FIGS. 2A-B illustrate respective side views of the swivel sub apparatus 114, in accordance with some embodiments of the present disclosure. Specifically, FIGS. 2A-B illustrate the displaceability of the control line 116 in response to rotation of the spool mandrel 122 with respect to the connector sub 120. FIG. 2A discloses the swivel sub 114 with the spool mandrel 122 in a neutral position with respect to the connector sub 120. As illustrated, the control line 116 may be secured to the connector sub 120 via a first control line housing 200. The first control line housing 200 may be secured to a radially outer connector surface 202 of the connector sub 120. Further, the first control line housing 200 may include a bore configured to receive the control line 116. That is, the control line 116 may extend through the bore. As the first control line housing 200 is secured to the connector sub 120, an inner surface of the bore may restrain radial and circumferential movement of the control line 116 with respect to the connector sub 120. The first control line housing 200 may also be configured to clamp onto the control line 116 to further restrain axial movement of the control line 116 with respect to the first control line housing 200.

Moreover, the control line 116 may be secured to a retainer sub 204 via a second control line housing 206 secured to a radially outer retainer surface 208 of the retainer sub 204. As illustrated, the control line 116 extends from the first control line housing 200 on the connector sub 120 across to the second control line housing 206 on the retainer sub 204. The second control line housing 206 may include a second bore configured to receive the control line 116 such that the control line may extend through the second bore. The inner surface of the second bore may restrain radial and circumferential movement of the control line 116 with respect to the connector sub 120. The second control line housing 206 may also be configured to clamp onto the control line 116 to restrain axial movement of the control line 116 with respect to the second control line housing 206. As the retainer sub 204 is rotationally fixed with respect to the connector sub 120, the first control line housing 200 and the second control line housing 206 may maintain a fixed distance during rotation of the spool mandrel, such that restraining axial movement of the control line 116 at the first control line housing 200 and the second control line housing 206 may not strain the control line 116 as the spool mandrel 122 rotates.

Additionally, the control line 116 may be secured to a clamped mandrel 210 via a third control line housing 212 secured to a radially outer clamped surface 214 of the clamped mandrel 210. The third control line housing 212 may include a third bore configured to receive the control line 116 such that the control line 116 may extend through the third bore. The inner surface of the third bore may restrain radial and circumferential movement of the control line 116 with respect to the clamped mandrel 210. Further, the third control line housing 212 may be configured to clamp onto the control line 116 to restrain axial movement of the control line 116 with respect to the clamped mandrel 210.

As illustrated, the control line 116 extends from the second control line housing 206 on the retainer sub 204 across to the third control line housing 212 on the clamped mandrel 210, which is disposed proximate a downhole end 126 of the swivel sub 114. Alternatively, the third control line housing 212 may be secured to another suitable tubular disposed proximate the downhole end 126 of the swivel sub 114. Moreover, the clamped mandrel 210, or other suitable tubular, may be rotationally fixed with respect to the spool mandrel 122. As such, rotation of the spool mandrel 122 may drive rotation of the clamped mandrel 210 with respect to the connector sub 120 and the retainer sub 204, which may also rotate the angular position of the control line 116 with respect to the downhole tool 108 (shown in FIG. 1). That is, rotating the spool mandrel 122 may drive rotation of the clamped mandrel 210 to rotate the mating end 124 of the control line 116 for aligning and mating with the corresponding connector 128 (shown in FIG. 1) of the downhole tool 108. Indeed, restraining axial movement of the control line 116 at the clamped mandrel 210 may hold the mating end 124 of the control line 116 in a fixed angular position on the clamped mandrel 210 at the downhole end 126 of the swivel sub 114 such that rotation of the spool mandrel 122 also rotates the angular position of the control line 116 with respect to the downhole tool 108.

Moreover, although the axial distance between the second control line housing 206 and the third control line housing 212 remains the same during rotation of the clamped mandrel 210 (i.e., the third control line housing 212 does not move axially with respect to the second control line housing 206), the rotation of the clamped mandrel 210 with respect to the connector sub 120 and the retainer sub 204 may increase the total distance between the second control line housing 206 and the third control line housing 212. As set forth above, the control line 116 extends from the second control line housing 206 on the connector sub 120 to the third control line housing 212 on the spool mandrel 122. As such, increasing the total distance between the second control line housing 206 and the third control line housing 212 may strain the control line 116.

To accommodate for the variable total distance between the second control line housing 206 and the third control line housing 212, as well as any twisting of the control line 116 from the rotation of the spool mandrel 122, the control line 116 may comprise a coiled portion 216 between the second control line housing 206 and the third control line housing 212. That is, the control line 116 may be coiled about the spool mandrel 122 (e.g., forming the coiled portion) between the second control line housing 206 and the third control line housing 212. The control line 116 may comprise a material that may be displaced (e.g., elastic deformation) without permanently straining (e.g., plastic deformation). As such, the coiled portion 216 of the control line 116 may be displaced (e.g., stretch, uncoil, recoil, etc.) in response to rotation of the spool mandrel 122 without permanently straining and damaging the control line 116. Further, increasing a number of coils or wraps of the coiled portion 216 about the spool mandrel 122 may increase a length of the control line 116 between the second control line housing 206 and the third control line housing 212. Increasing the length of the control line 116 may reduce strain on the control line 116 by spreading the deformation or displacement across a greater length. As such, the coiled portion 216 of the control line 116 may be advantageous for reducing strain on the control line 116 as the spool mandrel 122 rotates to vary the distance between the second control line housing 206 and the third control line housing 212.

FIG. 2B discloses the swivel sub apparatus 114 with the spool mandrel 122 in a rotated position with respect to the connector sub 120. In particular, the spool mandrel 122 is rotated counterclockwise with respect to the connector sub 120. Such rotation increases the distance between the second control line housing 206 and the third control line housing 212. As set forth above, the control line 116 is axially fixed at the second control line housing 206 and the third control line housing 212. As such, the coiled portion 216 of the control line 116 may be displaced (e.g., stretch, uncoil, etc.) to accommodate the increased distance between the second control line housing 206 and the third control line housing 212.

Moreover, rotating the spool mandrel 122 back to the neutral position may reduce the distance between the second control line housing 206 and the third control line housing 212. As such, the coiled portion 216 of the control line 116 may recoil and/or compress back to a neutral state to reduce slack in the control line 116 between the second control line housing 206 and the third control line housing 212. Such displacement of the coiled portion 216 may permit rotation of the spool mandrel 122 between the first angular position and the second angular position without permanently straining and damaging the control line 116.

Figure 3:
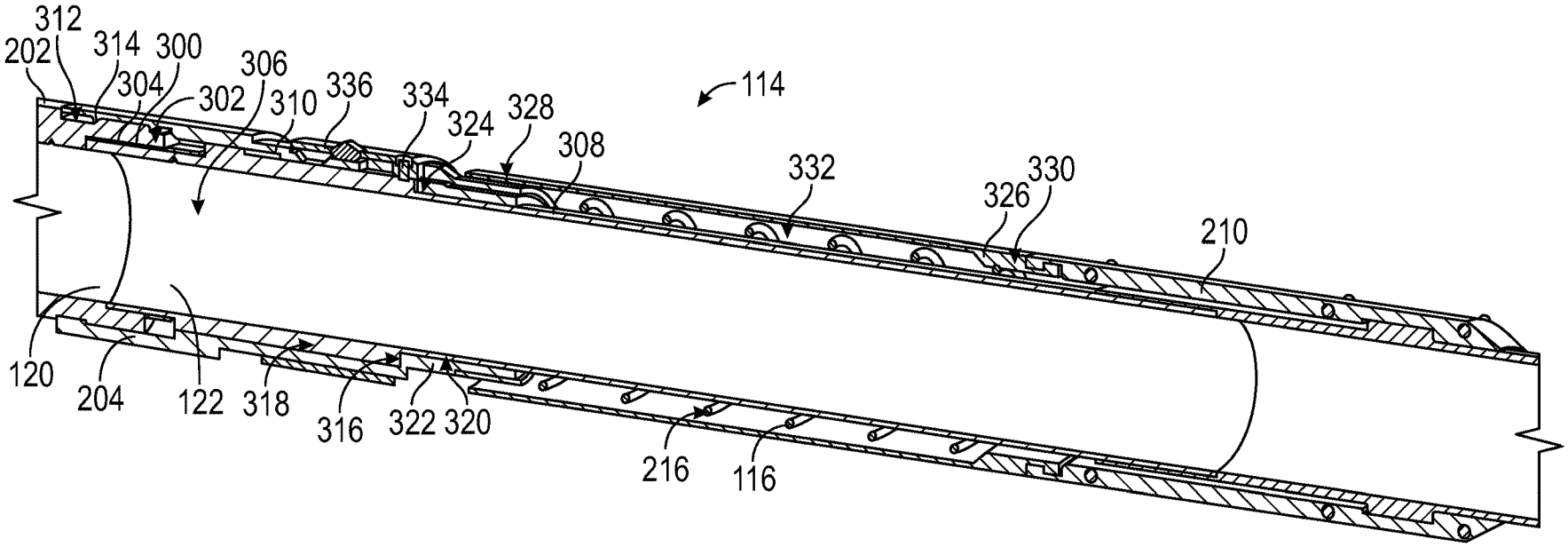
FIG. 3 illustrates a cross-sectional view of a swivel sub apparatus, in accordance with some embodiments of the present disclosure.

FIG. 3 illustrates a cross-sectional view of the swivel sub apparatus 114, in accordance with some embodiments of the present disclosure. The swivel sub 114 has the connector sub 120 and the spool mandrel 122 rotatably coupled to the connector sub 120. As illustrated, the spool mandrel 122 may be at least partially disposed within the connector sub 120. In particular, the connector sub 120 and the spool mandrel 122 each comprise a substantially tubular shape. A radially inner connector surface 300 of a downhole end 302 of the connector sub 120 may have a greater diameter than a radially outer mandrel surface 304 of an uphole end 306 of the spool mandrel 122, such that the uphole end 306 of the spool mandrel 122 may be disposed in the downhole end 302 of the connector sub 120. Having the uphole end 306 of the spool mandrel 122 disposed in the downhole end 302 of the connector sub 120 may restrain radial movement of the spool mandrel 122 with respect to the connector sub 120. However, the spool mandrel 122 may be free to rotate with respect to the connector sub 120 between the first angular position and the second angular position via the interface between the spool mandrel 122 and the connector sub 120.

Moreover, the swivel sub 114 may include a retainer sub 204 for restraining axial movement of the spool mandrel 122 with respect to the connector sub 120. As illustrated, the retainer sub 204 may be disposed radially exterior to the connector sub 120 and the spool mandrel 122. The connector sub 120 and the spool mandrel 122 may each include slots and or shoulders formed in their respective radially outer surfaces (e.g., radially outer connector surface 202 and radially outer spool surface 308). The retainer sub 204 may include corresponding features formed in a radially inner retainer surface 310 of the retainer sub 204 for interfacing with the slots and/or shoulders formed in connector sub 120 and spool mandrel 122. Such interfaces may restrain axial movement of the spool mandrel 122 with respect to the connector sub 120.

For example, as illustrated, the connector sub 120 may include an outer connector slot 312 formed in the radially outer connector surface 202 of the connector sub 120. The outer connector slot 312 may at least partially extend about the circumference of the connector sub 120. The retainer sub 204 may include a corresponding retainer protrusion 314 extending radially inward from the radially inner retainer surface 310 of the retainer sub 204. The retainer protrusion 314 may at least partially extend about the circumference of the radially inner retainer surface 310. The retainer protrusion 314 may be disposed within the outer connector slot 312 and contact between the retainer protrusion 314 and the outer connector slot 312 may restrain axial movement of the connector sub 120 with respect to the retainer sub 204. Further, the swivel sub 114 may include additional fasteners and/or interfaces to rigidly secure or affix the connector sub 120 to the retainer sub 204 (e.g., restrain axial, radial, and rotational movement between the connector sub 120 and the retainer sub 204).

Moreover, the spool mandrel 122 may include a spool shoulder 316 formed at a transition between a protruding portion 318 of the spool mandrel 122 and a base portion 320 of the spool mandrel 122. The protruding portion 318 may have a larger diameter than the base portion 320 such that the spool shoulder 316 is formed at the transition. As illustrated, the retainer sub 204 may include a radially inner lip 322 formed in the radially inner retainer surface 310 of the retainer sub 204. An uphole end 324 of the radially inner lip 322 may interface with the spool shoulder 316 to restrain downhole movement of the spool mandrel 122 with respect to the retainer sub 204 and the connector sub 120. Additionally, uphole movement of the spool mandrel 122 with respect to the retainer sub 204 and the connector sub 120 may be restrained by an interface between the uphole end 306 of the spool mandrel 122 and the downhole end 302 of the connector sub 120. As such, axial movement between the spool mandrel 122 and the connector sub 120 may be restrained.

Additionally, a shroud 326 may be disposed about the coiled portion 216 of the control line 116. A downhole end 330 of the shroud 326 may be secured to the clamped mandrel 210, and an uphole end 328 of the shroud 326 may be positioned proximate to the retainer sub 204, but not secured to the retainer sub 204 such that the shroud 326 may rotate with respect to the retainer sub 204. Alternatively, the uphole end 328 of the shroud 326 may be secured to the retainer sub 204, and the downhole end 330 of the shroud 326 may be positioned proximate the clamped mandrel 210, but not secured to the clamped mandrel 210 such that the clamped mandrel 210 may rotate with respect to the shroud 326. Moreover, the shroud 326 may be radially offset from the spool mandrel 122 such that a control line cavity 332 is formed between the spool mandrel 122 and the shroud 326 for housing the coiled portion 216 of the control line 116. The shroud 326 may shield the coiled portion 216 of the control line 116 from the downhole environment.

Moreover, as set forth above, the spool mandrel 122 may freely rotate with respect to the connector sub 120 between the first angular position and the second angular position. However, as the swivel sub 114 is run-in-hole, rotation of the spool mandrel 122 with respect to the connector sub 120 may be undesirable. As such, the swivel sub 114 may include a shear member 334 (e.g., shear pin or other suitable fastener) configured to restrain rotation of the spool mandrel 122 with respect to the connector sub 120. The shear member 334 may initially hold the spool mandrel 122 in a neutral position between the first and second angular position. However, once the swivel sub 114 is positioned proximate the downhole tool 108, rotation of the spool mandrel 122 may be needed to re-orient the control line 116 with respect to the corresponding connector 128 of the downhole tool 108. As such, the swivel sub 114 may include a shear mechanism 336 to shear the shear member 334, which releases the spool mandrel 122 to rotate with respect to the connector sub 120. As set forth in greater detail below, the shear mechanism 336 may be configured to actuate in response to the shear mechanism 336 contacting the downhole tool 108 (shown in FIG. 1). Such contact may apply a threshold force needed for shearing the shear member 334.

Figure 4:
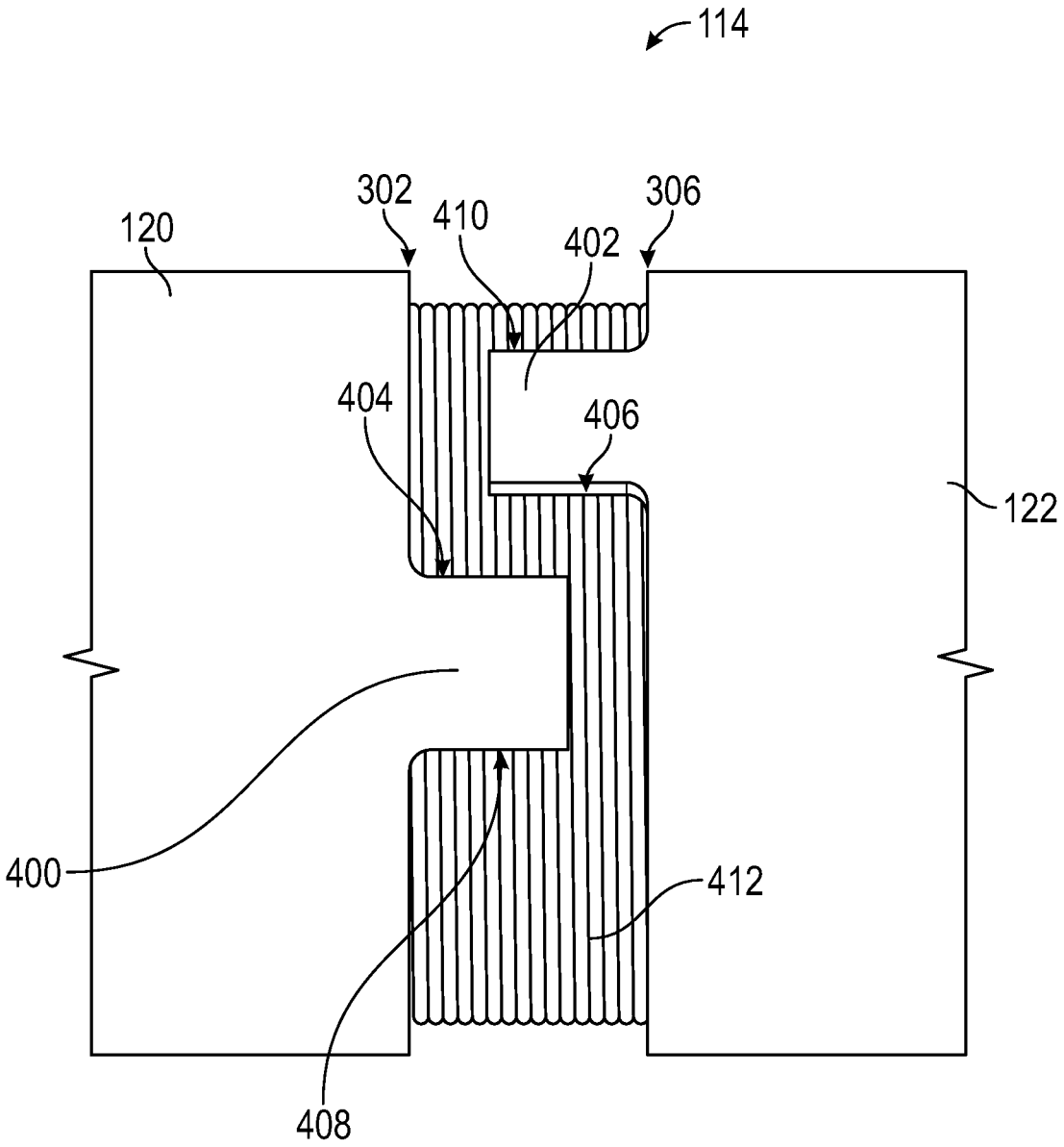
FIG. 4 illustrates a side view of a connector sub and a spool mandrel of a swivel sub apparatus, in accordance with some embodiments of the present disclosure.

FIG. 4 illustrates a side view of the connector sub 120 and the spool mandrel 122 of the swivel sub apparatus 114, in accordance with some embodiments of the present disclosure. The connector sub 120 may include a connector lug 400. As illustrated, the connector lug 400 may comprise an axially extending connector lug that may extend axially outward from the downhole end 302 of the connector sub 120. However, the connector lug 400 may comprise any suitable shape and/or orientation. Moreover, the spool mandrel 122 may include a mandrel lug 402. The mandrel lug 402 may comprise an axially extending mandrel lug that may extend axially outward from the uphole end 306 of the spool mandrel 122. However, the mandrel lug 402 may also comprise any suitable shape and/or orientation.

Figure 5C:
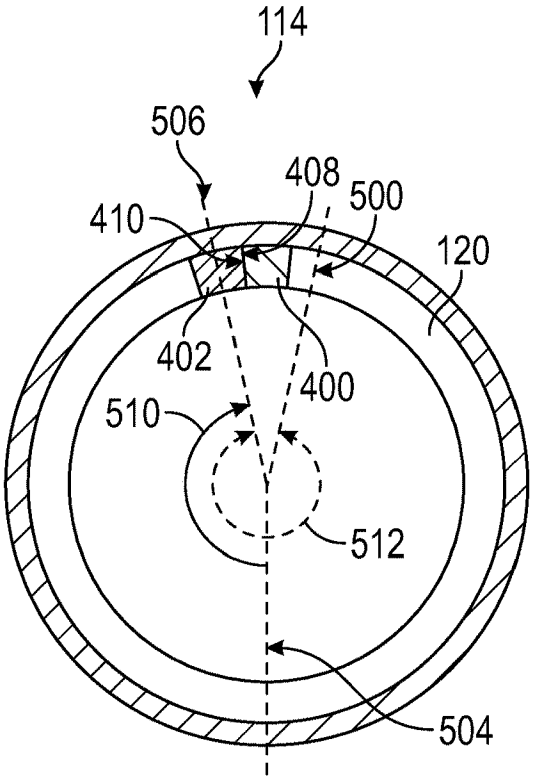
FIGS. 5A-C illustrate respective cross-sectional views of a connector lug of a connector sub and a mandrel lug of a spool mandrel, in accordance with some embodiments of the present disclosure.
Figure 5B:
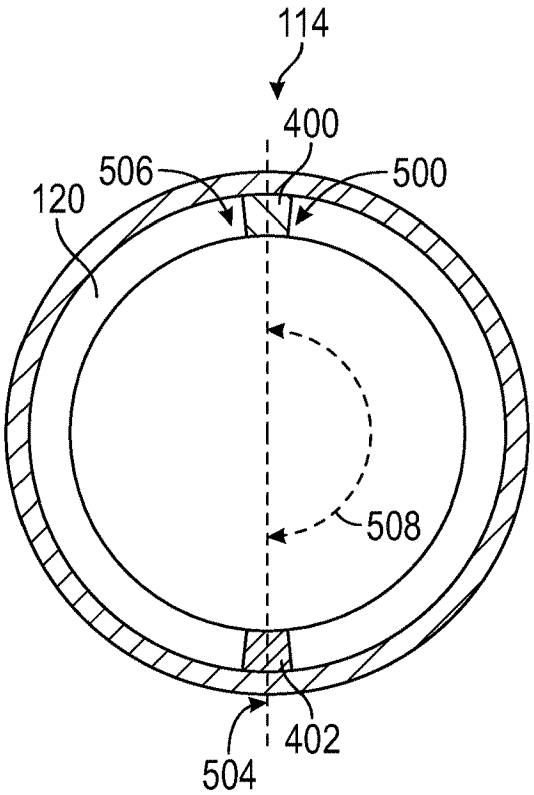
Figure 5A:
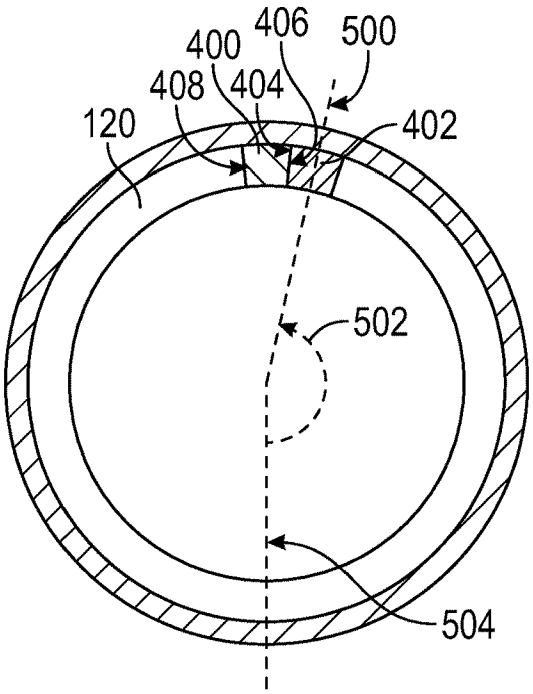

As set forth above, the spool mandrel 122 is rotatable with respect to the connector sub 120 between the first angular position and the second angular position (shown in FIGS. 5A-C). Contact between the connector lug 400 and the mandrel lug 402 is configured to bound rotation of the spool mandrel 122 with respect to the connector sub 120 between the first angular position and the second angular position. In particular, rotation of the spool mandrel 122 with respect to the connector sub 120 is bounded in a first direction (e.g., a counterclockwise direction) at the first angular position by contact between a first side 404 of the connector lug 400 and a first side 406 of the mandrel lug 402, and rotation is bounded in a second direction (e.g., clockwise direction) at the second angular position by contact between a second side 408 of the connector lug 400 and a second side 410 of the mandrel lug 402. Thus, the spool mandrel 122 may be configured to rotate bi-directionally between the first side 404 and the second side 408 of the connector lug 400.

The swivel sub 114 may further include at least one return spring 412 configured to bias the spool mandrel 122 to rotate toward a neutral angular position of the spool mandrel 122 with respect to the connector sub 120. The neutral position may orient the mandrel lug 402 in an angular position between the first side 404 and the second side 408 of the connector lug 400 such that the spool mandrel 122 may rotate either clockwise or counterclockwise in response to contact with the downhole tool 108. Alternatively, the neutral position may orient the mandrel lug 402 proximate the first side 404 or the second side 408 of the connector lug 400 to permit additional rotation in either the clockwise or the counterclockwise direction in response to contact with the downhole tool 108. Moreover, the at least one return spring 412 may comprise a compression spring, a tension spring, a torsion spring, or some combination thereof.

FIGS. 5A-C illustrate respective cross-sectional views of the connector lug 400 of the connector sub 120 and the mandrel lug 402 of the spool mandrel, in accordance with some embodiments of the present disclosure. FIG. 5A discloses the mandrel lug 402 disposed in the first angular position 500 with respect to the connector lug 400 of the connector sub 120. The mandrel lug 402 may be disposed in the first angular position 500 in response to being rotated in a first direction 502 (e.g., the counterclockwise direction) from a neutral position 504. In the first angular position 500, the first side 406 of the mandrel lug 402 is disposed proximate the first side 404 of the connector lug 400. Indeed, the spool mandrel 122 may be bounded in the first direction 502 at the first angular position 500 by contact between the first side 404 of the connector lug 400 and the first side 406 of the mandrel lug 402. As set forth above, restraining angular movement of the spool mandrel 122 with respect to the connector sub 120 may prevent over-rotation of the spool mandrel 122 and avoid strain and damage to the control line 116 (shown in FIGS. 2A-B).

Moreover, the connector lug 400 and the mandrel lug 402 may each span between five degrees and forty-five degrees of the corresponding circumference of the connector sub 120 and the spool mandrel 122, respectively. Rotation of the spool mandrel 122 is bounded by rotation of the mandrel lug 402 between the first side 404 of the connector lug 400 and the second side 408 of the connector lug 400. As such, minimizing the circumferential width of the connector lug 400 and the mandrel lug 402 may increase the range of rotation of the spool mandrel 122. However, the connector lug 400 and the mandrel lug 402 may require sufficient circumferential width to support rotational forces exerted on the spool mandrel 122 and connector sub 120.

FIG. 5B discloses the mandrel lug 402 disposed in a neutral position 504. As set forth above, the swivel sub 114 may include at least one return spring (shown in FIG. 4) configured to bias the mandrel lug 402 toward the neutral position 504 for the spool mandrel 122. As illustrated, the neutral position 504 may be disposed between the first angular position 500 and the second angular position 506. For example, the neutral position 504 may be a position having the mandrel lug 402 angularly offset from the connector lug 400 by between one hundred and thirty five degrees to two hundred and twenty five degrees. In the illustrated embodiment, the mandrel lug 402 is angularly offset from the connector lug 400 by an offset angle 508 of one hundred and eighty degrees. Alternatively, the neutral position 504 may be at the first angular position 500 or the second angular position 506 (shown in FIG. 5C, or any suitable angular position between the first angular position 500 and the second angular position 506.

FIG. 5C discloses the mandrel lug 402 disposed in the second angular position 506 with respect to the connector sub 120. The mandrel lug 402 may be disposed in the second angular position 506 in response to being rotated in a second direction 510 (e.g., the clockwise direction) from the neutral position 504. Indeed, the mandrel lug 402 may rotate bi-directionally from the neutral position 504 toward either the first angular position 500 or the second angular position 506. In the second angular position 506, the second side 410 of the mandrel lug 402 is disposed proximate the second side 408 of the connector lug 400. Indeed, the spool mandrel 122 may be bounded in the second direction 510 at the second angular position 506 by contact between the second side 408 of the connector lug 400 and the second side 410 of the mandrel lug 402. The first angular position 500 and the second angular position 506 may be offset by a maximum offset angle 512 between two hundred and seventy to three hundred and sixty degrees apart. As such, the spool mandrel 122 may freely rotate two hundred and seventy degrees to three hundred and sixty degrees between the first angular position 500 and the second angular position 506 in response to contact of the swivel sub 114 with the downhole tool 108 to align the mating end 124 of the control line 116 with the corresponding connector 128 of the downhole tool 108 (shown in FIG. 1).

Figure 6:
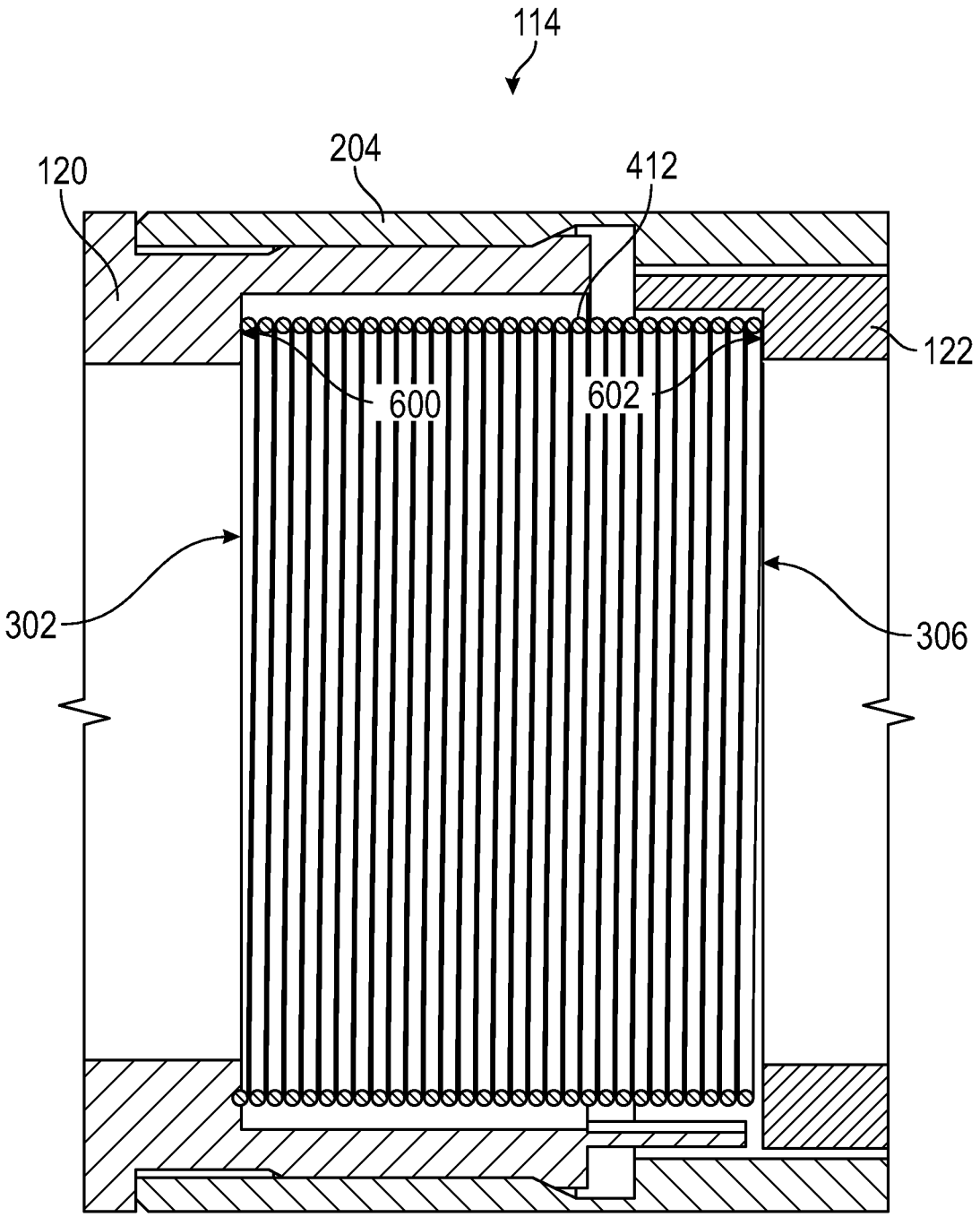
FIG. 6 illustrates a cross-sectional view of a return spring of a swivel sub apparatus, in accordance with some embodiments of the present disclosure.

FIG. 6 illustrates a cross-sectional view of the return spring 412 of a swivel sub apparatus 114, in accordance with some embodiments of the present disclosure. As set forth above, the return spring 412 may be configured to bias the spool mandrel 122 toward the neutral position 504 (shown in FIG. 5B) of the spool mandrel 122 with respect to the connector sub 120. As illustrated, a first end 600 of the return spring 412 may be secured to the connector sub 120 and a second end 602 of the return spring 412 may be secured to the spool mandrel 122 such that the return spring 412 may bias the spool mandrel 122 with respect to the connector sub 120.

Moreover, as illustrated, the downhole end 302 of the connector sub 120 may be axially offset from the uphole end 306 of the spool mandrel 122. As such, the retainer sub 204 may restrain both radial and axial movement of the spool mandrel 122 with respect to the connector sub 120. Further, the connector sub 120 may comprise the axially extending connector lug 400 and the spool mandrel 122 may include the axially extending mandrel lug 402 (shown in FIG. 4). Contact between the axially extending connector lug 400 and the axially extending mandrel lug 402 may bound rotation of the spool mandrel 122 with respect to the connector sub 120 between the first angular position 500 and the second angular position 506 (shown in FIGS. 5A-C).

Figure 7B:
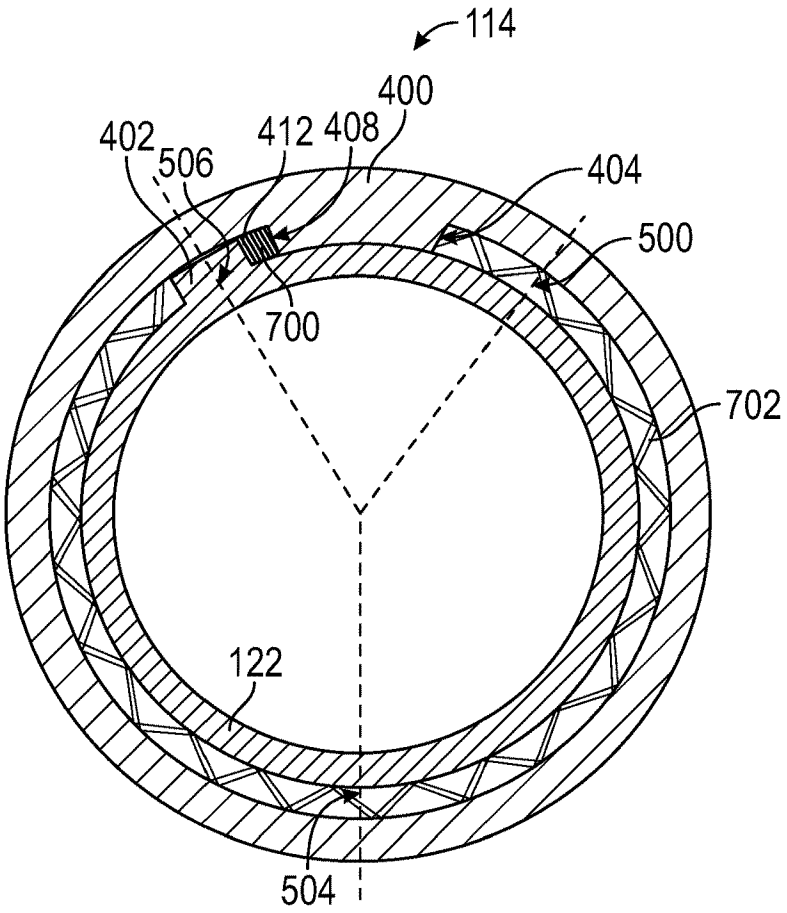
FIGS. 7A-B illustrate respective cross-sectional views of a radially extending connector lug and a radially extending mandrel lug, in accordance with some embodiments of the present disclosure.
Figure 7A:
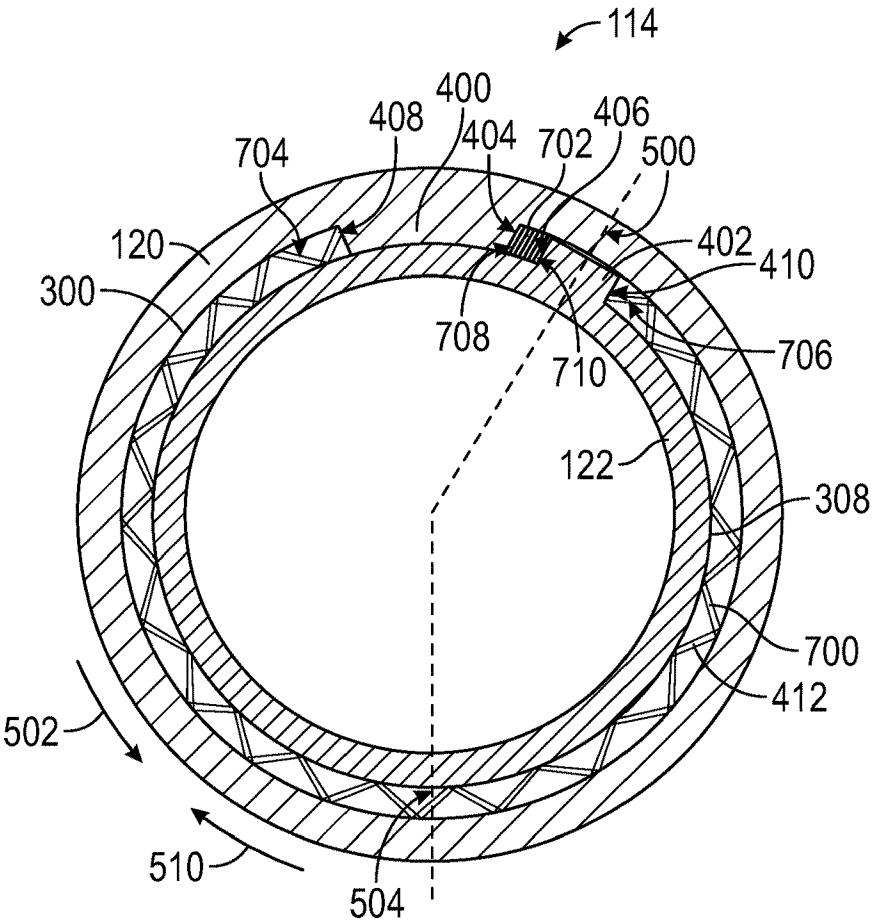

FIGS. 7A-B illustrate respective cross-sectional views of a radially extending connector lug 400 and a radially extending mandrel lug 402, in accordance with some embodiments of the present disclosure. FIG. 7A discloses the swivel sub apparatus 114 having the mandrel lug 402 disposed in the first angular position 500. As illustrated, the connector sub 120 has the connector lug 400 that extends radially inward from the radially inner connector surface 300 of the connector sub 120. Further, the spool mandrel 122 has mandrel lug 402 that extends radially outward from the radially outer spool surface 308 of the spool mandrel 122. Each of the connector lug 400 and the mandrel lug 402 each span between five degrees and forty-five degrees of the corresponding circumference of the connector sub 120 and the spool mandrel 122, respectively.

Moreover, the swivel sub 114 comprises the at least one return spring 412 configured to bias the spool mandrel 122 to rotate toward the neutral angular position 504 of the spool mandrel 122 with respect to the connector sub 120. As illustrated, the at least one return spring 412 may comprise a first return spring 700 and a second return spring 702. The first return spring 700 is configured to bias the mandrel lug 402 in the first direction 502 (e.g., the counterclockwise direction) to drive the first side 406 of the mandrel lug 402 toward the first side 404 of the connector lug 400. Moreover, the first return spring 700 may be configured to bias the mandrel lug 402 and the connector lug 400 directly. That is, the first end 704 of the first return spring 700 may be attached to the second side 408 of the connector lug 400 and the second end 706 of the first return spring 700 may be attached to the second side 410 of the mandrel lug 402. Moreover, the second return spring 702 is configured to bias the mandrel lug 402 in the second direction 510 (e.g., the clockwise direction) to drive the second side 410 of the mandrel lug 402 toward the second side 408 of the connector lug 400. Moreover, the second return spring 702 may be configured to bias the mandrel lug 402 and the connector lug 400 directly. That is, the first end 708 of the second return spring 702 may be attached to the connector lug 400 and the second end 710 of the second return spring 702 may be attached to the mandrel lug 402. Further, the at least one return spring 412 (e.g., the first return spring 700 and the second return spring 702) may include any suitable type of spring. In the illustrated embodiment, the at least one return spring 412 may comprise a compression spring for biasing the mandrel lug 402 with respect to the connector lug 400.

FIG. 7B discloses the swivel sub apparatus 114 having the mandrel lug 402 disposed in the second angular position 506. In response to contact with the downhole tool 108, the spool mandrel may rotate to re-orient the mating end 124 of the control line 116 with the corresponding connector 128 of the downhole tool 108 (shown in FIG. 1). Such rotation may drive the mandrel lug 402 of the spool mandrel 122 in the clockwise or counterclockwise direction. In the illustrated embodiment, the mandrel lug 402 has been rotated in the clockwise direction away from the first side 404 of the connector lug 400 and toward to the second side 408 of the connector lug 400. Rotation of the mandrel lug 402 in the clockwise direction may compress the first return spring 700. Additionally, such rotation in the clockwise direction may place the second return spring 702 in tension. Pulling the swivel sub 114 away from the downhole tool 108 may release the spool mandrel 122 such that the first return spring 700 and/or the second return spring 702 may bias the mandrel lug 402 in the counterclockwise direction toward the neutral position 504.

Figure 8A:
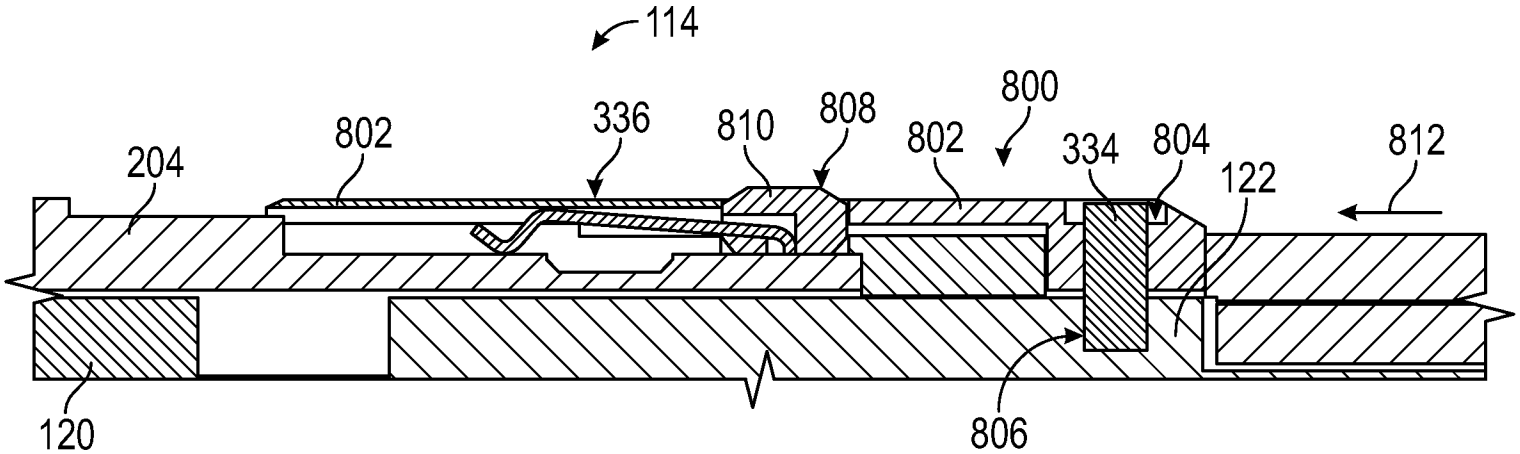
FIGS. 8A-B illustrate respective cross-sectional views of a sliding pin shear mechanism, in accordance with some embodiments of the present disclosure.
Figure 8B:
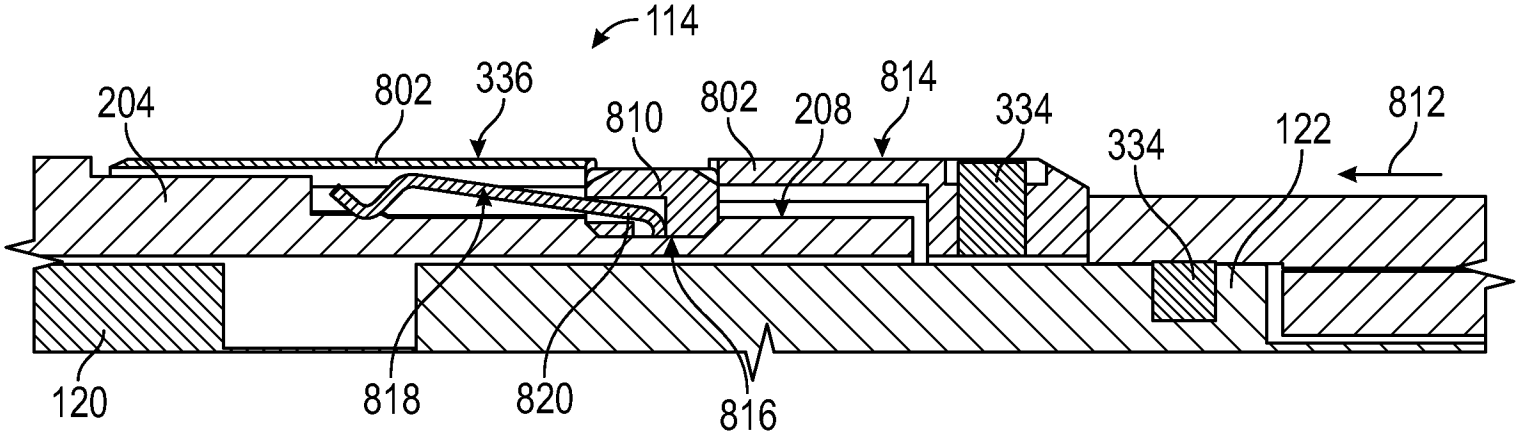

FIGS. 8A-B illustrate respective cross-sectional views of the shear mechanism 336, in accordance with some embodiments of the present disclosure. In particular, FIG. 8A discloses the shear mechanism 336 and the shear member 334 (e.g., shear pin) holding the spool mandrel 122 in a run-in position (e.g., a position of the spool mandrel 122 while being run-in-hole). As set forth above, the retainer sub 204 may be rigidly secured to the connector sub 120 such that the retainer sub 204 is axially and rotationally fixed with respect to the connector sub 120. Further, the shear mechanism 336 may be secured to the retainer sub 204 in a first axial position 800. The shear mechanism 336 may comprise a sleeve 802 having a shear member slot 804. As illustrated, the shear member 334 may be disposed in the shear member slot 804 to hold the spool mandrel 122 in the run-in position as the swivel sub 114 is run-in-hole. That is, the shear member 334 may extend through the shear member slot 804 and into a spool slot 806 formed in the spool mandrel 122. As such, the shear member 334 may restrain rotational movement, as well as axial movement, between the shear mechanism 336 and the spool mandrel 122, which may restrain rotational movement between the spool mandrel 122 and the connector sub 120.

The shear mechanism 336 may further comprise an interface feature 808 configured to engage (e.g., contact) the downhole tool 108 as the conveyance 118 drives the swivel sub 114 into the downhole tool 108 (shown in FIG. 1). As set forth above, the shear member 334 may restrain axial movement of the sleeve 802 of the shear mechanism 336 with respect to the spool mandrel 122. The interface feature 808 may include a protrusion (e.g., retractable interface pin 810) extending radially outward from the sleeve 802. Indeed, the retractable interface pin 810 may be disposed in a radially extended position as the swivel sub 114 is run-in-hole. As the retractable interface pin 810 engages the downhole tool 108, a force on retractable interface pin 810 may drive the sleeve 802 in the axially uphole direction 812 with respect to the spool mandrel 122. The shear member 334 may restrain axial movement of the sleeve 802 with respect to the spool mandrel 122. However, in response to at least a threshold force being applied to the retractable interface pin 810 from the engagement of the retractable interface pin 810 with the downhole tool 108, the sleeve 802 may shear the shear member 334 and slide in the axially uphole direction 812. As such, the shear mechanism 336 may be configured to shear the shear member 334 in response to the swivel sub apparatus 114 engaging a downhole tool 108 disposed in the wellbore 104 (shown in FIG. 1).

FIG. 8B discloses the shear mechanism 336 disposed in a locked position 814 (e.g., a second axial position) after sliding in the axially uphole direction 812 in response to the shear member 334 being sheared. As set forth above, the interface feature (e.g., retractable interface pin 810) is disposed in the radially extended position as the swivel sub 114 is run-in-hole. Specifically, the radially outer retainer surface 208 of the retainer sub 204 may bias the retractable interface pin 810 toward the radially extended position in the run-in position. However, in the locked position 814, the retractable interface pin 810 may be axially aligned with a corresponding interface feature slot 816 formed in the retainer sub 204. The retractable interface pin 810 is configured to retract into the interface feature slot 816 as the shear mechanism 336 slides to the locked position 814. The retractable interface pin 810 may cease to engage the downhole tool 108 once retracted such that the shear mechanism 336 avoids interfering with rotation of the spool mandrel 122 with respect to the downhole tool 108 as the mating end 124 of the control line 116 is re-oriented to mate with the corresponding connector 128 of the downhole tool 108 (shown in FIG. 1).

Moreover, the shear mechanism 336 may further include a locking mechanism 818 configured to secure the shear mechanism 336 in the locked position 814. As illustrated, the locking mechanism 818 may include a biasing arm 820 connected to the retractable interface pin 810. The biasing arm 820 may be configured to bias the retractable interface pin 810 radially inward to hold the retractable interface pin 810 in the interface feature slot 816 in the locked position 814. Further, contact between axial surfaces of the retractable interface pin 810 and the interface feature slot 816 may restrain axial movement of the retractable interface pin 810, which also restrains axial movement of the sleeve 802 to hold the shear mechanism 336 in the locked position 814. Although, a particular shear mechanism 336 is shown in the illustrated embodiment, the swivel sub 114 may include any suitable shear mechanism to shear the shear member 334 and release to spool mandrel 122 to rotate with respect to the connector sub 120 in response to engagement of the swivel sub 114 with the downhole tool 108.

Accordingly, the present disclosure may provide a swivel sub having a spool mandrel configured to rotate with respect to a connector sub, between a first angular position and a second angular position, to align a mating end of a control line with a corresponding connector of a downhole tool while avoiding straining and damaging the control line. The systems and methods may include any of the various features disclosed herein, including one or more of the following statements.

Statement 1. An apparatus, comprising: a connector sub rigidly securable to a conveyance for running the connector sub along a wellbore, the connector sub having a connector lug; a spool mandrel coupled to the connector sub and having a mandrel lug, wherein the spool mandrel is rotatable with respect to the connector sub, and wherein contact between the connector lug and the mandrel lug bounds rotation of the spool mandrel with respect to the connector sub between a first angular position and a second angular position; and a control line extending between the connector sub and the spool mandrel, wherein the control line is displaceable to permit rotation of the spool mandrel with respect to the connector sub.

Statement 2. The apparatus of statement 1, wherein the spool mandrel is bi-directionally rotatable with respect to the connector sub.

Statement 3. The apparatus of any preceding statement, wherein rotation of the spool mandrel is bounded in a first direction by contact between a first side of the connector lug and a first side of the mandrel lug and is bounded in a second direction by contact between a second side of the connector lug and a second side of the mandrel lug.

Statement 4. The apparatus of any preceding statement, wherein the first angular position and the second angular position are between 270 to 360 degrees apart.

Statement 5. The apparatus of any preceding statement, wherein the connector lug extends axially outward from a downhole end of the connector sub, and wherein the mandrel lug extends axially outward from an uphole end of the spool mandrel.

Statement 6. The apparatus of any preceding statement, wherein a downhole end of the connector sub is axially offset from an uphole end of the spool mandrel.

Statement 7. The apparatus of any preceding statement, wherein the connector lug and the mandrel lug each span between five degrees and forty-five degrees of a corresponding circumference of the connector sub and the spool mandrel, respectively.

Statement 8. The apparatus of any preceding statement, wherein mandrel lug is angularly offset from the connector lug by 135 to 225 degrees in a neutral position of the spool mandrel.

Statement 9. The apparatus of any preceding statement, further comprising a retainer sub disposed radially exterior to the connector sub and the spool mandrel, wherein the retainer sub restrains axial movement of the spool mandrel with respect to the connector sub to couple the spool mandrel to the connector sub.

Statement 10. The apparatus of any preceding statement, further comprising a shear member initially holding the spool mandrel in a neutral position between the first and second angular position, wherein the shear member is shearable in response to a threshold force applied to an interface surface of the shear member.

Statement 11. The apparatus of any preceding statement, wherein the shear member comprises a shear pin securing the spool mandrel to a retainer sub, and wherein the retainer sub is rigidly secured to the spool mandrel.

Statement 12. The apparatus of any preceding statement, wherein the connector sub and the spool mandrel each comprise a tubular shape.

Statement 13. The apparatus of any of statements 1-5 or statements 7-12, wherein a radially inner connector surface of a downhole end of the connector sub has a greater diameter than a radially outer mandrel surface of an uphole end of the spool mandrel, and wherein the uphole end of the spool mandrel is disposed within the downhole end of the of the connector sub.

Statement 14. The apparatus of any of statements 1-4 or statements 6-13, wherein the connector lug extends radially inward from the radially inner connector surface of the connector sub, and wherein the mandrel lug extends radially outward from the radially outer mandrel surface of the spool mandrel.

Statement 15. An apparatus, comprising: a connector sub rigidly securable to a conveyance for running the connector sub along a wellbore, the connector sub having an axially extending connector lug; a spool mandrel coupled to the connector sub and having an axially extending mandrel lug, wherein the spool mandrel is rotatable with respect to the connector sub, and wherein contact between the connector lug and the mandrel lug bounds rotation of the spool mandrel with respect to the connector sub between a first angular position and a second angular position; control line extending between the connector sub and the spool mandrel, wherein the control line is displaceable to permit rotation of the spool mandrel with respect to the connector sub; and a return spring configured to bias the spool mandrel to rotate toward a neutral angular position of the spool mandrel with respect to the connector sub.

Statement 16. The apparatus of statement 15, wherein a first end of the return spring is attached to the connector lug, and wherein a second end of the return spring is attached to the mandrel lug.

Statement 17. The apparatus of statement 15 or statement 16, wherein the return spring comprises a compression spring, a tension spring, a torsion spring, or some combination thereof.

Statement 18. The apparatus of any of statements 15-17, wherein the control line is coiled about the spool mandrel in the neutral position, wherein the control line uncoils in response to rotation of the spool mandrel in a first direction, and wherein the control line recoils in response to rotation of the spool mandrel in a second direction.

Statement 19. A method for mating a downhole swivel sub to a downhole tool, comprising: running a swivel sub into a wellbore via a conveyance, wherein the swivel sub comprises: a connector sub rigidly securable to a conveyance for running the connector sub along a wellbore, the connector sub having an axially extending connector lug; a spool mandrel coupled to the connector sub and having an axially extending mandrel lug, wherein the spool mandrel is rotatable with respect to the connector sub, and wherein contact between the connector lug and the mandrel lug bounds rotation of the spool mandrel with respect to the connector sub between a first angular position and a second angular position; and a control line extending between the connector sub and the spool mandrel, wherein the control line is displaceable to permit rotation of the spool mandrel with respect to the connector sub; and actuating a shear mechanism to shear a shear pin restraining rotation of the spool mandrel with respect to the connector sub; driving the swivel sub into the downhole tool to couple the swivel sub with the downhole tool, wherein the spool mandrel rotates with respect to the connector sub to a position between the first angular position in response to driving the swivel sub into a downhole tool; and disengaging the swivel sub from the downhole tool in response to an unsuccessful coupling of the control line with the downhole tool, wherein a return spring drives the spool mandrel to rotate toward a neutral angular position of the spool mandrel with respect to the connector sub in response to disengaging the swivel sub from the downhole tool.

Statement 20. The method of statement 19, wherein the shear mechanism is configured to actuate in response to the shear mechanism contacting the downhole tool.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An apparatus, comprising:

a connector sub rigidly securable to a conveyance for running the connector sub along a wellbore, the connector sub having a connector lug;

a spool mandrel coupled to the connector sub and having a mandrel lug, wherein the spool mandrel is rotatable with respect to the connector sub, and wherein contact between the connector lug and the mandrel lug bounds rotation of the spool mandrel with respect to the connector sub between a first angular position and a second angular position; and a control line extending between the connector sub and the spool mandrel, wherein the control line is displaceable in response to rotation of the spool mandrel with respect to the connector sub.

2. The apparatus of claim 1, wherein the spool mandrel is bi-directionally rotatable with respect to the connector sub.

3. The apparatus of claim 1, wherein rotation of the spool mandrel is bounded in a first direction by contact between a first side of the connector lug and a first side of the mandrel lug and is bounded in a second direction by contact between a second side of the connector lug and a second side of the mandrel lug.

4. The apparatus of claim 1, wherein the first angular position and the second angular position are between 270 to 360 degrees apart.

5. The apparatus of claim 1, wherein the connector lug extends axially outward from a downhole end of the connector sub, and wherein the mandrel lug extends axially outward from an uphole end of the spool mandrel.

6. The apparatus of claim 1, wherein a downhole end of the connector sub is axially offset from an uphole end of the spool mandrel.

7. The apparatus of claim 1, wherein the connector lug and the mandrel lug each span between five degrees and forty-five degrees of a corresponding circumference of the connector sub and the spool mandrel, respectively.

8. The apparatus of claim 1, wherein the mandrel lug is angularly offset from the connector lug by 135 to 225 degrees in a neutral position of the spool mandrel.

9. The apparatus of claim 1, further comprising a retainer sub disposed radially exterior to the connector sub and the spool mandrel, wherein the retainer sub restrains axial movement of the spool mandrel with respect to the connector sub to couple the spool mandrel to the connector sub.

10. The apparatus of claim 1, further comprising a shear member initially holding the spool mandrel in a neutral position between the first and second angular position, wherein the shear member is shearable in response to a threshold force applied to an interface surface of the shear member.

11. The apparatus of claim 10, wherein the shear member comprises a shear pin securing the spool mandrel to a retainer sub, and wherein the retainer sub is rigidly secured to the spool mandrel.

12. The apparatus of claim 1, wherein the connector sub and the spool mandrel each comprise a tubular shape.

13. The apparatus of claim 1, wherein a radially inner connector surface of a downhole end of the connector sub has a greater diameter than a radially outer mandrel surface of an uphole end of the spool mandrel, and wherein the uphole end of the spool mandrel is disposed within the downhole end of the connector sub.

14. The apparatus of claim 13, wherein the connector lug extends radially inward from the radially inner connector surface of the connector sub, and wherein the mandrel lug extends radially outward from the radially outer mandrel surface of the spool mandrel.

15. An apparatus, comprising:

a connector sub rigidly securable to a conveyance for running the connector sub along a wellbore, the connector sub having an axially extending connector lug;

a spool mandrel coupled to the connector sub and having an axially extending mandrel lug, wherein the spool mandrel is rotatable with respect to the connector sub, and wherein contact between the connector lug and the mandrel lug bounds rotation of the spool mandrel with respect to the connector sub between a first angular position and a second angular position;

a control line extending between the connector sub and the spool mandrel, wherein the control line is displaceable in response to rotation of the spool mandrel with respect to the connector sub; and a return spring configured to bias the spool mandrel to rotate toward a neutral angular position of the spool mandrel with respect to the connector sub.

16. The apparatus of claim 15, wherein a first end of the return spring is attached to the connector lug, and wherein a second end of the return spring is attached to the mandrel lug.

17. The apparatus of claim 15, wherein the return spring comprises a compression spring, a tension spring, a torsion spring, or some combination thereof.

18. The apparatus of claim 15, wherein the control line is coiled about the spool mandrel in the neutral position, wherein the control line uncoils in response to rotation of the spool mandrel in a first direction, and wherein the control line recoils in response to rotation of the spool mandrel in a second direction.

19. A method for mating a downhole swivel sub to a downhole tool, comprising:

running a swivel sub into a wellbore via a conveyance, wherein the swivel sub comprises:

a connector sub rigidly securable to a conveyance for running the connector sub along a wellbore, the connector sub having an axially extending connector lug;

a spool mandrel coupled to the connector sub and having an axially extending mandrel lug, wherein the spool mandrel is rotatable with respect to the connector sub, and wherein contact between the connector lug and the mandrel lug bounds rotation of the spool mandrel with respect to the connector sub between a first angular position and a second angular position; and a control line extending between the connector sub and the spool mandrel, wherein the control line is displaceable in response to rotation of the spool mandrel with respect to the connector sub; and actuating a shear mechanism to shear a shear pin restraining rotation of the spool mandrel with respect to the connector sub;

driving the swivel sub into the downhole tool to couple the swivel sub with the downhole tool, wherein the spool mandrel rotates with respect to the connector sub to a position between the first angular position and the second angular position in response to driving the swivel sub into a downhole tool; and disengaging the swivel sub from the downhole tool in response to an unsuccessful coupling of the control line with the downhole tool, wherein a return spring drives the spool mandrel to rotate toward a neutral angular position of the spool mandrel with respect to the connector sub in response to disengaging the swivel sub from the downhole tool.

20. The method of claim 19, wherein the shear mechanism is configured to actuate in response to the shear mechanism contacting the downhole tool.

* * * * *